343-872 SR
3/1/88 OR 4,728,962

United States Patent [19]
Kitsuda et al.

[11] Patent Number: 4,728,962
[45] Date of Patent: Mar. 1, 1988

[54] MICROWAVE PLANE ANTENNA

[75] Inventors: Yoshihiro Kitsuda; Toshio Abiko; Kyoji Masamoto, all of Osaka; Katsuya Tsukamoto, Yawata, all of Japan

[73] Assignee: Matsushita Electric Works, Ltd., Osaka, Japan

[21] Appl. No.: 784,478

[22] Filed: Oct. 4, 1985

[30] Foreign Application Priority Data

| | | | |
|---|---|---|---|
| Oct. 12, 1984 | [JP] | Japan | 59-153733[U] |
| Jan. 14, 1985 | [JP] | Japan | 60-4500 |
| Feb. 25, 1985 | [JP] | Japan | 60-36206 |
| Feb. 25, 1985 | [JP] | Japan | 60-35516 |
| Apr. 24, 1985 | [JP] | Japan | 60-89344 |

[51] Int. Cl.[4] ..... H01Q 1/42; H01Q 1/38
[52] U.S. Cl. ..... 343/872; 343/700 MS; 343/702
[58] Field of Search ..... 343/700 MS, 731, 829, 343/830, 872, 873, 702

[56] References Cited

U.S. PATENT DOCUMENTS

| | | | |
|---|---|---|---|
| 2,956,281 | 10/1960 | McMillan et al. | 343/872 |
| 3,302,207 | 1/1967 | Hoffman | 343/731 |
| 3,558,423 | 1/1971 | Rossetti, Jr. | 428/251 |
| 3,596,271 | 7/1971 | Cosslett et al. | 343/731 |
| 3,745,583 | 7/1973 | Herbert | 343/742 |
| 4,312,002 | 1/1982 | Stewart | 343/872 |
| 4,397,035 | 8/1983 | Nothnagel et al. | 343/872 |
| 4,455,682 | 1/1984 | Masters | 343/702 |
| 4,475,107 | 10/1984 | Makimoto et al. | 343/700 MS |

FOREIGN PATENT DOCUMENTS

| | | | |
|---|---|---|---|
| 0105103 | 4/1984 | European Pat. Off. . | |
| 3149200 | 1/1982 | Fed. Rep. of Germany . | |
| 2131232 | 6/1984 | United Kingdom | 343/700 MS |

OTHER PUBLICATIONS

"Antenna Engineering Hand Book", edited by H. Jasik, published by McGraw Hill Book Co., Inc., 1961, Chapter 32.

Walton, Jr., J. D., "Radome Engineering Handbook", Design & Principles, 1970, Marcel Dekker, Inc., New York, pp. 169–175.

*Primary Examiner*—William L. Sikes
*Assistant Examiner*—Doris J. Johnson
*Attorney, Agent, or Firm*—Burns, Doane, Swecker & Mathis

[57] ABSTRACT

A microwave plane antenna comprising antenna body including a plurality of conductive microstrip lines covered with a plastic film and a polyolefin series dielectric layer provided along the microstrip lines for lowering SHF band transmission loss while elevating reception gain. The antenna is enclosed in a plastic cover which includes portions constructed to permit the passage of microwaves while imparting appreciable strength to the cover.

6 Claims, 19 Drawing Figures

MICROWAVE PLANE ANTENNA

TECHNICAL BACKGROUND OF THE INVENTION

This invention relates to a microwave plane antenna for receiving circularly polarized waves.

The microwave plane antenna of the type referred to is effective to receive circularly polarized waves carried on an SHF band, in particular, 12 GHz band, from a geostationary broadcasting satellite launched into cosmic space 36,000 Km high from the earth.

DISCLOSURE OF PRIOR ART

Antennas generally used by listeners for receiving such circularly polarized waves sent from the geostationary broadcasting satellite are parabolic antennas erected on the roof or the like position of a building. However, the parabolic antenna is susceptible to strong wind to be easily felled thereby due to its bulky structure so that an additional means for stably supporting the antenna will be necessary. Such supporting means further require such troublesome work as a fixing to the antenna of reinforcing pole members forming a major part of the supporting means, which may cost more than the antenna itself.

In an attempt to eliminate these problems of the parabolic antenna, there has been suggested in Japanese Patent Appln. Laid-Open Publication No. 99803/1982 (corresponding to U.S. Pat. No. 4,475,107 or to German Offenlegungsschrift No. 3149200) a plane antenna, which is of flattened configuration and comprises a plurality of microstrip lines arranged in rows, a circuit connected to these lines at their one end for supplying a traveling-wave current parallel to them in the same amplitude and phase, and termination resistors each connected to the other end of the respective lines, for providing a reception gain close to that of the parabolic antenna. For this type of plane antenna, such a low loss polyolefin circuit board as disclosed in U.S. Pat. No. 3,558,423 may be employed, the circuit board being obtained by stacking a glassfiber mat, a plastic sheet and a metallic foil and forming the cranked strip lines with the metallic foil by means of an etching.

Such plane antenna is made to have a proper directivity and is mounted on a wall surface or the like position of a building without requiring any expensive supporting means, and hence the plane antenna is generally to be disposed outdoors. In this respect, there can be enumerated further such known plane antenna bodies as a glass-backed Teflon and copper-clad board employing Teflon (Trademark) as a dielectric member, a glass cloth-backed crosslinked polyethylene and copper-clad board employing crosslinked polyethylene as the dielectric member and the like, which are improved to some extent in durability with a weatherproofness provided. However, they have been still defective in that they become expensive, the plastic materials employed are large in the transmission loss at the SHF band so as not to be able to assure a sufficiently high reception gain enough for attaining reception characteristics close to those of the parabolic antenna, and, further, their interfacial transmission loss is caused to be increased by the influence of water on interfaces between glass fiber and resins after long use. Here, it may be possible to employ, as the dielectric member, polyethylene or such polyolefin as suggested in the foregoing U.S. Pat. No. 3,558,423 to lower the fabricating cost as well as the SHF band transmission loss for a higher reception gain, but the weatherproofness is left remarkably poor, causing the reception gain to be deteriorated, whereby the antenna is less reliable.

There has been a further problem that, when the plane antenna is used outdoors with the microstrip lines directly exposed to the atmosphere, the microstrip lines themselves are subject to corrosion to reduce the life of the antenna.

For eliminating the problem referred to immediately above, there has been suggested by Jeff J. Wilson, in Japanese Patent Application Laid-Open Publication No. 59-89006 (to which U.K. Pat. No. 8227490 corresponds), to cover the exposed surface of the microstrip lines of the plane antenna with a thin polymerizable film so as to protect them. According to this suggestion, the microstrip lines may possibly be prevented from being corroded by means of the thin film, whereas a dielectric layer disposed below the microstrip lines is still not protected and deteriorates after a long use, and the problem in respect of the long term durability still has been left unsolved. Further, the suggestion is to only provide the thin polymerizable film on the microstrip lines of the plane antenna, and the dielectric layer is shown to be formed in a honeycomb structure or with a foamed material, causing such further problem that the antenna is not sufficiently durable against external force. Also, a contact bonding of the thin film as well as any further layer for grounding purposes with respect to the dielectric layer of such structure is not reliable and the film is easily peeled off.

TECHNICAL FIELD OF THE INVENTION

A primary object of the present invention is, therefore, to provide a plane antenna which allows employment of a plastic material as a dielectric member which is effective in lowering the transmission loss at SHF band and elevating the reception gain to be close to that of the parabolic antenna, and which can be mass produced to lower the fabricating cost, still assuring a reliable usage for long.

According to the present invention, this object can be realized by providing a microwave plane antenna which comprises an antenna body including a plurality of microstrip lines arranged in rows and layers of a dielectric member and a grounding conductor which are joined with the microstrip lines, the dielectric member being a plastic material which restraining the transmission loss at SHF band and elevates the reception gain. A current feeding circuit is connected to the microstrip lines at one end, wherein the microstrip lines are covered by a plastic sheet intimately provided over the microstrip lines, and the antenna body is enclosed in a plastic cover.

Other objects and advantages of the present invention shall be made clear in the following description of the invention detailed with reference to preferred embodiments shown in the accompanying drawings.

Figure 1:
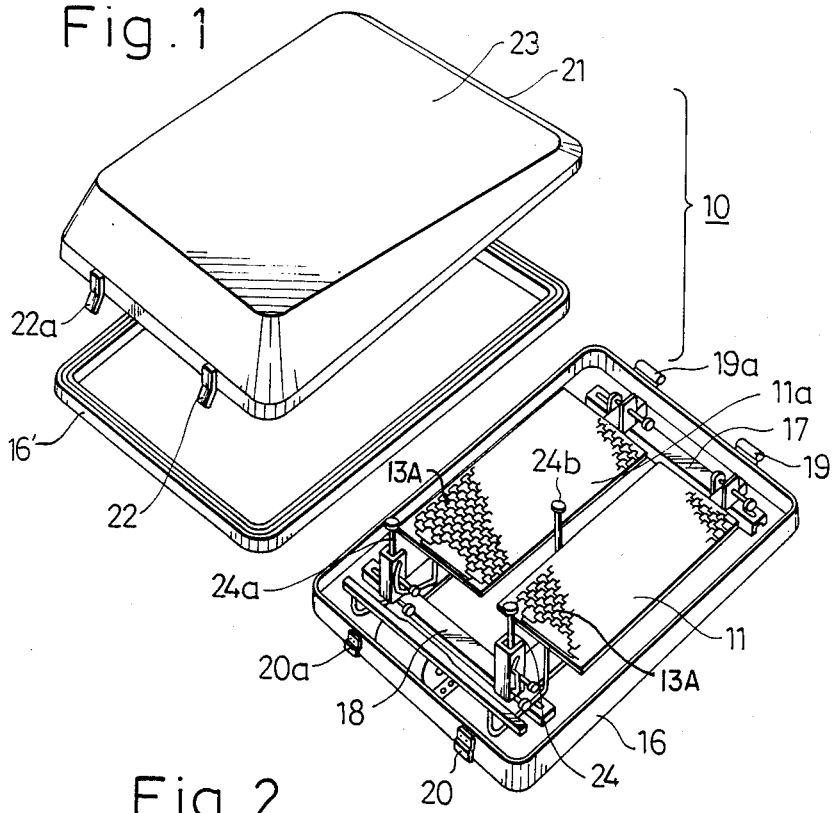
FIG. 1 is a perspective view of a microwave plane antenna in an embodiment according to the present invention with a cover disassembled.
Figure 2:
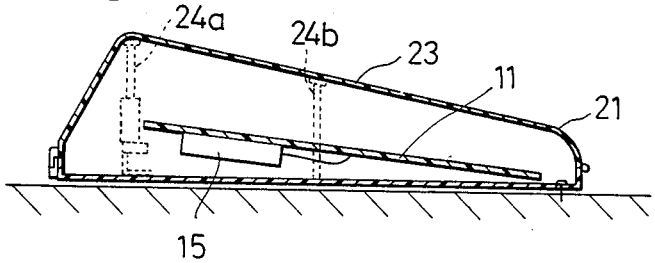
FIG. 2 is a schematic sectional view showing only major parts of the plane antenna of FIG. 1.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Referring to FIGS. 1 to 4, a microwave plane antenna 10 according to the present invention includes antenna bodies 11 and 11*a* having respectively a dielectric layer 12 provided on the top face with a plurality of microstrip lines 13 arranged in crank-shaped rows and covered by a thin plastic film 25 and on the bottom face with an earthing or grounding conductor 14. The dielectric layer 12 is made of polyethylene which is inexpensive and still capable of restraining the transmission loss at SHF band to maintain a desired reception gain. While the microstrip lines may be made of a 10 to 200μ thick metallic foil of, for example, iron, copper, nickel or an alloy thereof, it is preferable in particular to employ aluminum or its alloy foil, the foil being subjected to an etching process to be formed into a continuous crank shape. The grounding conductor 14 is made of a metallic sheet having a small surface resistivity to microwaves such as gold, silver, copper, brass, zinc, iron, aluminum or the like. The microstrip lines 13 and grounding conductor 14 are bonded to the dielectric layer 12 with an olefin adhesive or the like. A conventional current feeding circuit 13*a* is connected to the microstrip lines, the circuit disclosed in aforementioned U.S. Pat. No. 4,475,107.

The thin plastic film 25 comprises preferably a polyethylene terephthalate film and functions to fully cover the microstrip lines 13 for preventing them from being corroded. In the present instance, an integrally bonded assembly of these microstrip lines 13 and thin plastic film 25 is practically obtainable in a manner, as will be detailed later with reference to FIGS. 10–12, for example, wherein a metallic foil web is initially contact-bonded to a surface of a web of the thin plastic film, a desired pattern of a resist ink is applied to the metallic foil web by means of a proper printing process or the like, and a desired pattern of the microstrip lines 13 is thereafter formed by performing an etching process with respect to the metallic foil web having the desired pattern of the resist ink therefor. Accordingly, the antenna bodies 11 and 11*a* can be obtained without subjecting the dielectric layer 12 to any immesion bath to avoid warpage warpage in the bodies, whereby any reinforcing with glass fiber hitherto required for the dielectric layer can be eliminated and thereby the transmission loss can be effectively restrained. As the microstrip lines 13 and plastic film 25 are contact-bonded under a certain pressure, a bonding interface between them can be sufficiently flattened for restraining the transmission loss at such interface.

Further, the grounding conductor 14 lies in parallel to the plane of the cranked microstrip lines 13, and functions to reflect and transmit incident microwaves and to provide a desired flatness and mechanical strength to the bodies 11 and 11*a*. The grounding conductor 14 is considerably rigid, so that a converter 15 can be mounted directly onto the back side of the conductor 14.

For the polyethylene forming the dielectric layer 12, specifically, one having a density of 0.91 to 0.97 is employed, so that the dielectric loss at the SHF band can be reduced from a conventional level of 2/1,000 to 2/10,000, that is, to be 1/10. In other words, it is made possible, by the employment of polyethylene for the dielectric layer 12, to restrain the SHF band transmission loss and to maintain the reception gain, in contrast to the known composite structure of Teflon and glass fiber layers.

In this case, the polyethylene-made dielectric layer 12 is effective on one hand to reduce the transmission loss but on the other hand to deteriorate the weatherproofness of the antenna bodies 11 and 11*a*. According to one feature of the present invention, therefore, it is suggested to enclose the antenna bodies 11 and 11*a* with a cover made of a plastic material which allows the microwaves transmitted from the broadcasting satellite to easily pass therethrough. More particularly, the antenna bodies 11 and 11*a* are mounted through a pivoting supporter 17 and height adjuster 18 onto a base 16 that can be fixed to an outdoor wall surface or the like. The supporter 17 and adjuster 18 are secured respectively adjacent each longitudinal end of the base 16. The antenna bodies 11 and 11*a* are pivoted at their one end to the supporter 17 and connected at the other end to the adjustor 18 for rendering the height at the other ends of the bodies 11 and 11*a* to be variable to thereby adjust the tilt angle of the bodies 11 and 11*a* with respect to the wall surface, whereby the incident angle of transmitted waves can be adjusted for a fine adjustment of the antenna's directivity. By this tilting support of the antenna bodies 11 and 11*a* onto the base 16, a space for accommodating the converter 15 can be assured between the lower surface of the bodies 11 and 11*a* and the upper surface of the base 16.

Further, the base 16 is provided at its end adjacent the supporter 17 with hinges 19 and 19*a* and at the other end with two engaging projections 20 and 20*a*. A plastic cover 21 fittable over the base 16 is secured at one end to the hinges 19 and 19*a* of the base 16, while two clamping members 22 and 22*a* are secured to the other end of the cover 21, and thus the cover 21 is pivotable about the hinges 19 and 19*a* between closing position with the clamping members 22 and 22*a* locked to the engaging members 20 and 20*a* of the base 16 and opening position with the members 20, 20*a* and 22, 22*a* unlocked from each other. The cover 21 is made of a plastic material through which the transmitted microwaves easily pass and which is weatherproof, such as polyethylene fluoride, methyl methacrylate resin, SAN resin, SA resin, polyisobutylene, polypropylene, polystyrene, ABS resin, polyvinyl chloride, polyvinylidene chloride, polyphenylene oxide, TPX resin, glass-fiber filled unsaturated polyester resin, glass-fiber filled silicone resin, polysulfone, polycarbonate, polyacetal, or of a multi-layer structure of more than two of these plastic materials. The cover 21 is formed into a bilge shape that can fully cover and enclose therein the antenna bodies 11 and 11*a* in all tilting postures. Accordingly, top wall 23 of the cover 21 is sloped gradually higher from the hinged end toward the other opening and closing end so as to be substantially parallel to the tilted bodies 11 and 11*a*. In the present instance, the cover 21 is made to be relatively thicker at peripheral portions along a downward open end edge, pratically in a region of a height less than 50 mm from the lower end edge the thickness is made to be more than 1 mm or, preferably, more than 1.5 mm, so that the mechanical strength of the cover will be increased. The opening and closing side part and the central part of the top wall 23 of the cover 21 are supported by a pair of supporting posts 24, 24*a* erected from the adjuster 18 and a similar post 24*b* erected from the base 16 so as not to deform inward nor to contact with the antenna bodies 11 and 11*a*, whereby the relatively thinner top wall 23 of the cover 21 is prevented from deforming even upon receipt of such external force as a strong wind that might otherwise cause the antenna bodies to be deformed or displaced to eventually alter the directivity. These supporting posts may be increased or decreased in number as required. In addition, a seal packing 16' may be provided between opposing edges of the base 16 and cover 21 for effecting a liquid seal therebetween.

Figure 5:
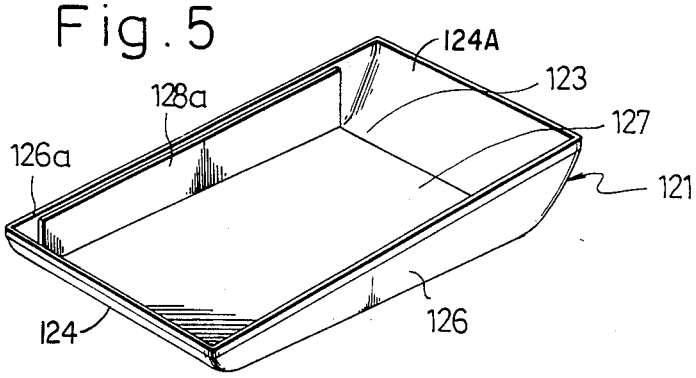
FIG. 5 is a perspective view of an antenna cover used in the plane antenna of another embodiment according to the present invention, as seen from its bottom side.
Figure 6:
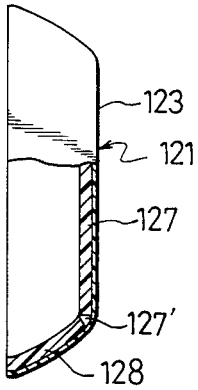
FIG. 6 shows a side view, partially in section, of the cover of FIG. 5.
Figure 7:
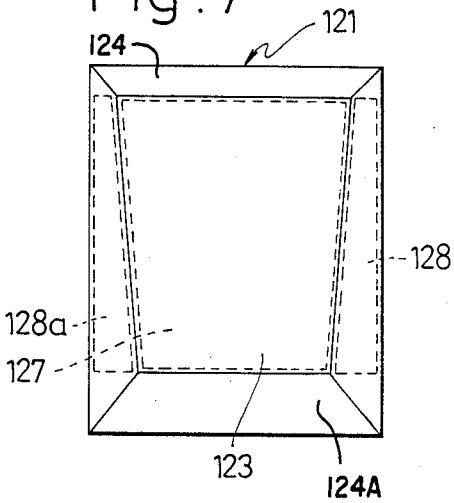
FIG. 7 is a plan view of the cover of FIG. 5.

According to another feature of the present invention, the plastic cover enclosing the antenna bodies is provided so as not to deteriorate the microwaves transmitted from the broadcasting satellite but to still increase the mechanical strength. Referring to FIGS. 5 to 7, there is shown a plastic cover 121 according to another embodiment of the plastic cover 21, which can be applied to the plane antenna of FIGS. 1 and 2. This plastic cover 121, comprises a top wall 123 and two side walls 126 and 126*a* diverging from the top wall 123 made to be less than 1 mm thick, preferably between about 0.1 and 0.5 mm, while other end walls 124, 124*a* are more than 1 mm thick, preferably above 2 mm. The thinner top and side walls 123, 126, 126*a* are made by impregnating a plain weave glass cloth with a compound of unsaturated polyester resin and curing agent, whereas the thicker end walls 124, 124*a* are made by impregnating a glass mat with a compound of unsaturated polyester resin and curing agent. The thinner top and both side walls 123, 126 and 126*a* are reinforced by foamed plastic layers 127, 128 and 128*a* adhered onto substantially the entire inner surface of the walls as shown by broken lines in FIG. 7. The foamed plastic layers 127, 128 and 128*a* may comprise a board of a polyolefin series material such as polyethylene, polyethylene-polystyrene copolymer or the like, having a foaming extent of 5 to 50 times, preferably 10 to 30 times, and a thickness of 1 to 100 mm, preferably 20 to 50 mm. Further, a reinforcing member 127' is filled between the layer 127 and the both side layers 128, 128*a*. It has been found that, when the fiberglass reinforced plastic cover 121 has a thickness of 1 mm, the reduction in the transmission factor of incident waves can be made small and, when the foamed plastic layers 127, 128 and 128*a* are respectively of a foaming extent of more than 5 and a thickness less than 100 mm, the reduction in the wave transmission factor can be made small, whereby the reduction in the reception gain at the antenna bodies can be made to be less than 1 dBi. Therefore, the present invention can provide an excellent reception gain in contrast to that reduced by a use of, for example, the fiberglass reinforced plastic layer as the dielectric layer of the antenna body in order to provide thereto the weatherproofness. It has been found further that, when the foamed plastic layers 127, 128 and 128*a* are of a foaming extent of less than 50 and preferably more than 1 mm respectively, the thinner regions of the cover 121 are reinforced.

In this manner, the transmitted waves from the broadcasting satellite can easily pass through the thinner regions of the plastic cover 121 with minimum loss, while the thicker regions having the considerable strength can function to hold the thinner regions. In the present embodiment, it is desirable that such supporting posts 24 and 24*a* as shown in FIG. 1 are also provided to carry the opening and closing end side of the top wall 123. For the plastic material of the cover 121, it is possible to employ the same material as that for the cover 21 of FIGS. 1–4 or, preferably, unsaturated polyester, epoxy resin, polyethylene, polypropylene, acrylic resin, polycarbonate or the like. The foamed plastic layer may be of polyurethane, polystyrene, or polyvinyl chloride.

Figure 8:
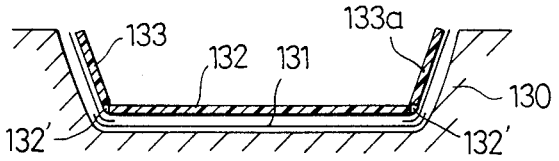
FIGS. 8 and 9 are schematic sectional views for explaining how to make the cover of FIG. 5.
Figure 9:
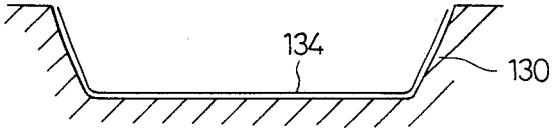

An embodiment of a process for producing the plastic cover 121 will be explained with reference to FIGS. 8 and 9. First, a mold 130 corresponding to the outer shape of the plastic cover 121 is prepared and a resin-impregnated glass cloth 131 is placed on the bottom and side surfaces of the mold 130, that is, on the regions of the mold corresponding to the top and side walls 123, 126 and 126*a* of the cover 121. The resin-impregnated glass cloth 131 is prepared by impregnating a woven glassfiber cloth with unsaturated polyester resin and curing agent. Subsequently, polyolefin series plastic boards 132, 133 and 133*a* are placed substantially on the entire resin-impregnated glass cloth 131 (FIG. 8). On the other hand, a relatively thick resin-impregnated glass mat 134 is placed on the longitudinal end walls of the mold 130, i.e., on parts of the cover 121 other than the top and side walls 123, 126 and 126*a* to be continuous to the resin-impregnated glass cloth 131 (FIG. 9), the resin-impregnated glass mat 134 having been prepared by impregnating a glassfiber mat with unsaturated polyester resin and curing agent. When the plastic cast into the mold has been hardened under such conditions, the resin-impregnated glass cloth 131 of the thinner regions, the resin-impregnated glass mat 134 of the thicker regions and the polyolefin series plastic boards 132, 133 and 133*a* are integrally joined, and the cover 121 is completed. Further, corner clearances between abutting peripheral edges of the polyolefin series plastic board 132 disposed on the top wall 123 and those of the other boards 133, 133*a* disposed on the side walls 126, 126*a* are filled with a reinforcing member 132' which is 1 to 50 mm wide, 1 to 50 mm high and more than 1 mm thick. This reinforcing member 132' is prepared preferably by impregnating a string-shaped base with a resin, the base being of a glass-fiber roving and the resin optimumly of unsaturated polyester, or alternatively the same plastic material as that used for the cover 121 or any material high in the adhesion may be used for the resin. As the reinforcing member 132' is to form a region impermeable to the transmitted waves, the member 132' should be made as small as possible. It will be appreciated in the above connection that the thickness of the resin-impregnated glass cloth and mat 131 and 134 as well as the foaming extent and thickness of the polyolefin series plastic boards 132, 133 and 133a are made to be in the ranges as mentioned above with respect to the cover 121.

Although the above-recited steps will result in the regions of the top and side walls 123, 126 and 126a of the cover 121 being thinner than the other regions, it will be appreciated that the other regions could be made thinner if the regions are to be permeable to the waves. Alternatively, even the top and side walls could be thicker so long as they are not intended to be permeable to the waves. In other words, the thinner regions should be regarded as the permeable regions while the thicker regions should be the impermeable regions.

To the inner surface of the mold 130 a gel-coat layer can be applied prior to the placing of the resin-impregnated glass cloth and mat 131 and 134. Also, a coating can be provided on the surface of the plastic cover 121. Further, the glass cloth may be of a twill fabric.

Comparative property tests have been made with respect to the antenna employing polyethylene as the dielectric layer according to the present invention and a known antenna employing Teflon, the results of which are as follows:

| | Antenna of the Invention | Antenna of Prior Art |
|---|---|---|
| Dielectric Constant: | 2.3 | 2.6 |
| Dielectric Loss: | $2.0 \times 10^{-4}$ | $2.2 \times 10^{-3}$ |
| Gain in the case of frontal type: | 31.1 dBi | 30.1 dBi |
| Gain in the case of side-look type: | 29.6 dBi | 28.7 dBi |

From the above, it should be appreciated that, in the product according to the present invention, the transmission loss is low and the reception gain is high.

According to still another feature of the present invention, there is provided a process for continuously manufacturing an antenna body as shown in particular in FIGS. 3 and 4 at a low cost, which shall be explained with reference to FIGS. 10 to 14. First, a metallic foil web 213 wound on a supply roll 241 for forming the microstrip lines 13 is supplied between an immersing roll 242 and a guide roll 243. The immersing roll 242 is partly dipped in a bath 244 of an adhesive agent so that the metallic foil web 213 can be continuously coated on its one side with the adhesive agent. After the foil web 213 coated with the adhesive agent has been dried through a drying chamber 245, the web is passed between a pair of nip rolls 246 and 246a, to which a thin film web 225 to be formed as the thin plastic film 25 is also supplied from a roll 247 to face the adhesive coated side of the web 213. During the passage of the webs 213 and 225 between the nip rolls 246 and 246a, the thin plastic film web 225 will be adhered to the metallic foil web 213, and a thus formed film-laminated metallic foil web 213a is wound on a take-up roll 248 (FIG. 10).

Figure 11:
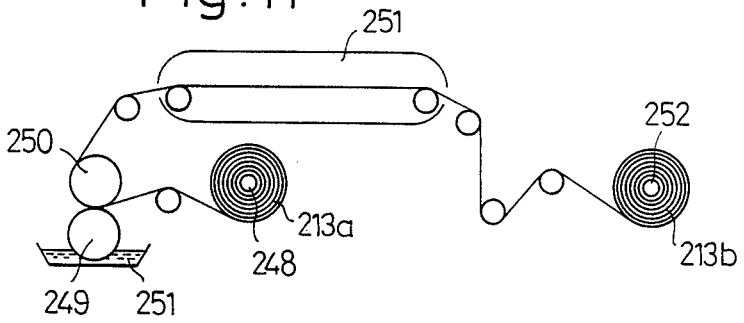
Figure 12:
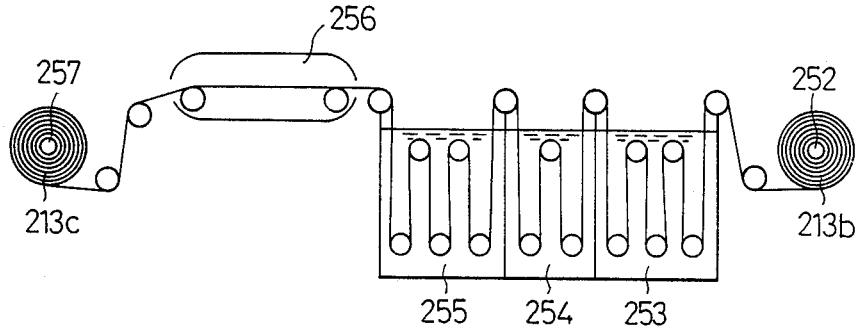

Then, the film-laminated metallic foil web 213a is paid out of the take-up roll 248 while held between a printing roll 249 and a guide roll 250, the printing roll 249 being partly dipped in a bath 251 of a resist ink so that a predetermined print pattern of the resist ink will be applied to the film-laminated metallic web 213a. The resist-ink-coated web 213a is dried when passed through a drying chamber 251 and then wound onto a take-up roll 252 (FIG. 11). Next, the resist-ink-coated web 213b is paid out of the take-up roll 252, passed sequentially through etching, neutralizing and washing baths 253, 254 and 255, dried in a drying chamber 256 and subsequently wound onto a take-up roll 257. In this manner, the metallic foil is subjected to the etching process to form the continuous cranked microstrip lines 13 on the thin plastic film web 225, and this web 225 is cut into pieces of a predetermined size.

Figure 3:
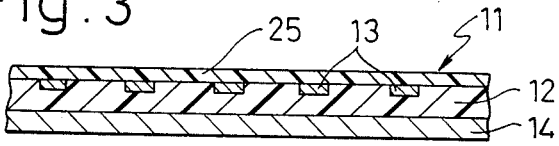
FIG. 3 is a fragmentary sectional view of the antenna body of the plane antenna of FIG. 1.
Figure 4:
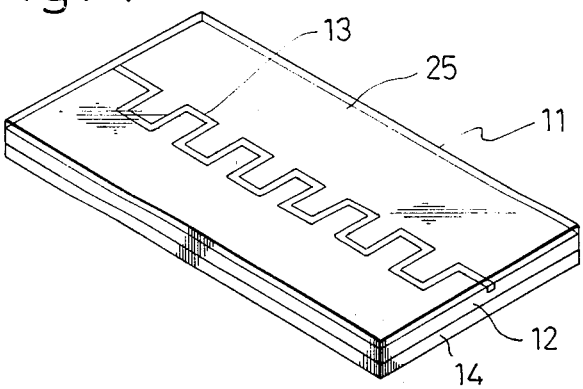
FIG. 4 is a fragmental perspective view of the antenna body of FIG. 3.
Figure 13:
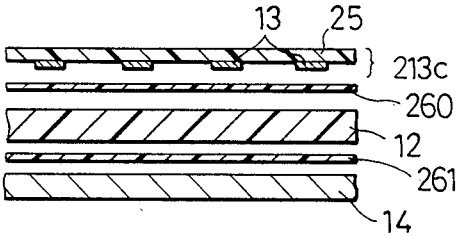
FIGS. 10 to 14 are schematic diagrams for explaining a process of manufacturing the antenna body applicable to the plane antenna of FIG. 1.

Further, the thin plastic film 25 carrying the microstrip lines 13 is joined with a bonding film 260, the dielectric layer 12, a bonding film 261 and the ground conductor 14 sequentially laminated, as shown in FIG. 13, a plurality of which laminates are held between a pair of pressing members 262 and 263 to be heated under a pressure, so that the antenna bodies 11 as shown in FIGS. 3 and 4 can be obtained.

Figure 14:
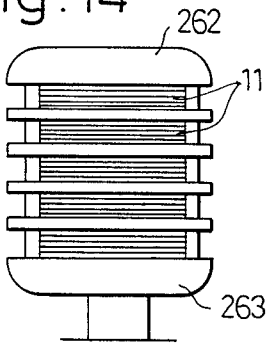
Figure 15:
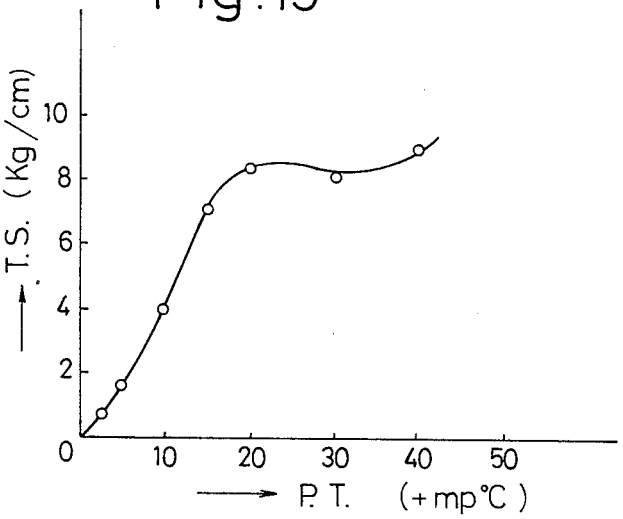
FIG. 15 is a graph showing a relationship between the pressing temperature and tearing strength of the antenna body made according to the manufacturing process of FIGS. 10 to 14.
Figure 10:
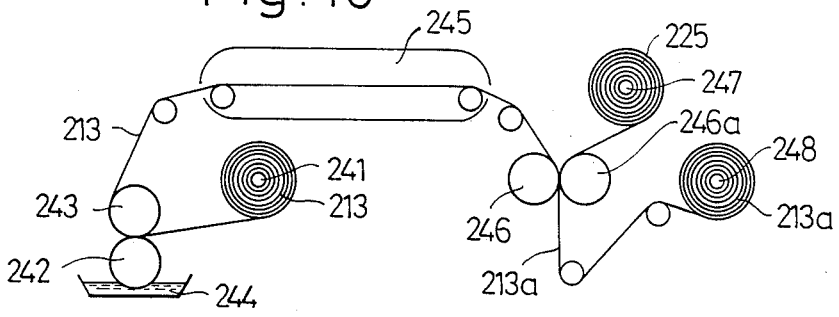

In the continuous manufacturing process of FIGS. 10 and 14, the metallic foil web 213 is made to be preferably between 10 and 40μ in thickness, and the thin plastic film web 225 may be of a polyethylene terephthalate film, polypropylene film, polybutylene terephthalate film or the like. As the printing method by the printing roll 249, a screen process, letterpress, gravure, photographic or the like printing may be employed. The etching process can be carried out in an alkaline solution as an aqueous sodium hydroxide solution, or in an acid solution such as an aqueous ferric oxide or cupric chloride solution. The dielectric layer 12 of polyethylene is selected to have a melt index (g/10 min) of less than 4, preferably less than 0.4, and the heating under the pressure between the members 262 and 263 is made at a temperature higher by 10°-50° C. than the melting point mp of polyethylene. Since the antenna body is installed outdoors, the tearing strength TS of the layer 12 is required to be higher than 4 Kg/cm, so that the heating temperature PT during the pressure application should be higher by more than 10° C. than the general melting point 126° C. of polyethylene or, optimumly, by more than 20° C. above the melting point 126° C. because a higher pressure heating temperature PT causes the tearing strength TS to be rapidly increased, as seen in FIG. 15.

According to a further embodiment of the present invention, the polyethylene dielectric antenna body is made by using a polyethylene having a low straight-chain density of above 0.95 g/cm$^3$ with ramifications less than 35 per 1000 carbons, preferably in a range of about 10 to 20, so that the high frequency insulating characteristic will be improved. Ultraviolet light absorber and antioxidant are added to the polyethylene dielectric layer.

Figure 16:
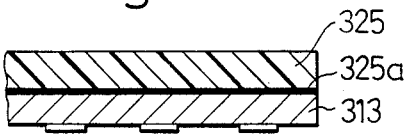
FIGS. 16 to 19 are diagrams for explaining another process of manufacturing the antenna body applicable to the plane antenna of FIG. 1.
Figure 17:
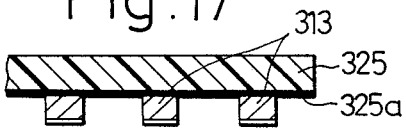
Figure 18:
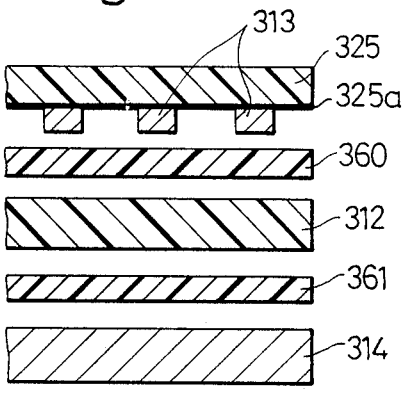
Figure 19:
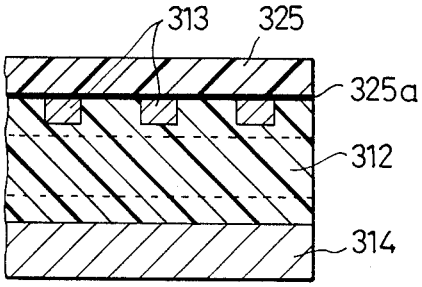

According to a still further feature of the present invention, another process is provided for fabricating the antenna body at a low cost, which will be explained with reference to FIGS. 16 to 19. First, a metallic foil layer 313 is bonded to a film 325 of a plastic such as polyester with an adhesive 325a and a resist ink is printed on the foil layer 313 by a suitable printing process in a pattern for forming the cranked microstrip lines 13 thereon (FIG. 16). Next, unnecessary parts of the metallic foil 313 are removed by an etching process (FIG. 17). Thereafter, the plastic film 325 having the etched microstrip line metallic foil 313 is joined with a polyolefin film 360 modified with an organic unsaturated acid, a non-polar polyolefin sheet 312 forming the dielectric layer, polyolefin film 361 modified with an organic unsaturated acid and a grounding conductor layer 314. Those films and layers are sequentially stacked on the side of the etched foil 313 (FIG. 18), and the stack is heated at a temperature higher preferably by 20°–50° C. than the melting point of the non-polar polyolefin sheet 312 to integrate them into the antenna body (FIG. 19). In this case, the polyester plastic film 325 having thereon the microstrip lines 13 as well as the ground conductor layer 314 are firmly coupled respectively to respective surfaces of the dielectric non-polar polyolefin layer 312 through the polyolefin films 360 and 361 which are modified to be polar by means of the organic unsaturated acid and thus to have a remarkably increased bonding strength for firmly integrating the layers 325, 312 and 314. For the organic unsaturated acid, unsaturated carboxylic acid and its derivatives may be employed. The former may comprise materials such as acrylic acid, methacrylic acid, maleic acid and the like, and the latter may comprise materials such as acid anhydride of unsaturated carboxylic acid, ester amide, imide and the like as, for example, anhydride maleic acid, anhydride citraconic acid, methyl methacrylate, dibutyl fumarate amide and the like. It will be appreciated that the process of the present embodiment is adaptable to a continuous line production as shown in FIGS. 10 to 14.

What is claimed as our invention is:

1. A microwave plane antenna comprising an antenna body including a plurality of rows of microstrip lines covered on one surface by a plastic sheet and joined on another surface with a layer of a dielectric material, a layer of a grounding conductor material joined to said layer of dielectric material, said dielectric layer restraining SHF band transmission loss for providing a high reception gain, a current feeding circuit connected to said microstrip lines, and means including a plastic cover enclosing therein said antenna body, wherein said plastic cover comprising permeable regions permeable to incident microwaves and impermeable regions impermeable to said microwaves, said permeable regions being made of a composite member comprised of a plastic sheet having a thickness less than 1 mm and a backing layer of a foamed plastic having a foaming extent of 5 to 50 times and 2 to 50 mm thick, said impermeable regions being of higher mechanical strength than said permeable regions.

2. A plane antenna according to claim 1, wherein said plastic sheet of said permeable regions is of a resin-impregnated glass cloth having a thickness of 0.1 to 0.5 mm, said glass cloth impregnated with a compound of unsaturated polyester resin and curing agent, said foamed plastic backing layer comprising a polyolefin series resin foamed to an extent of 10 to 30 times and 20 to 50 mm thick, and said impermeable regions comprising a resin-impregnated glass mat having a thickness more than 2 mm, said glass mat impregnated with a compound of unsaturated polyester resin and curing agent.

3. A plane antenna according to claim 1, wherein said plastic cover has a top wall and peripheral side walls, and boundary corners of said top and side walls are reinforced by a reinforcing member of a resin-impregnated base of glass-fiber roving.

4. A plane antenna according to claim 1, which further comprises a generally rectangular plate-shaped base having first and second faces, said first face adapted to be fixed against an outdoor wall surface, said antenna body being generally of rectangular plate-shape, one end of said antenna body mounted on said second face of said base for pivotal movement enabling an opposite end of said antenna body to move toward and away from said base as said body is pivoted, said cover mounted to said base and shaped to fully cover and enclose therein said antenna body in all pivoted postures thereof.

5. A plane antenna according to claim 4, wherein said cover is of a generally rectangular box shape including a top wall portion, peripheral side wall portions, and peripheral end wall poritons, said top wall portion being sloped gradually higher from an end of the cover disposed adjacent said pivotable mounting of said antenna body toward an opposite end adjacent said movable end of said antenna body, said top wall portion and said side wall portions forming said permeable regions and said end wall portions forming said impermeable regions of the cover.

6. A plane antenna according to claim 5, which further comprises support means projecting from said base toward said top wall portion of said cover for resisting inward deformation of said cover.

* * * * *